United States Patent [19]

La Capra

[11] 4,247,113

[45] Jan. 27, 1981

[54] BOARD GAME APPARATUS

[76] Inventor: Matthew La Capra, 358 Emory Rd., Mineola, N.Y. 11501

[21] Appl. No.: 32,040

[22] Filed: Apr. 23, 1979

[51] Int. Cl.[3] ..... A63F 3/00

[52] U.S. Cl. ..... 273/250

[58] Field of Search ..... 273/248–254, 273/256

[56] References Cited

U.S. PATENT DOCUMENTS

| | | | |
|---|---|---|---|
| 1,574,394 | 2/1926 | Holme | 273/252 |
| 2,976,044 | 3/1961 | Corpening | 273/256 |
| 3,711,966 | 1/1973 | Dresak | 273/282 |

FOREIGN PATENT DOCUMENTS

| | | | |
|---|---|---|---|
| 2650545 | 5/1978 | Fed. Rep. of Germany | 273/253 |
| 1015952 | 1/1966 | United Kingdom | 273/253 |

*Primary Examiner*—Richard C. Pinkham
*Assistant Examiner*—Scott L. Brown
*Attorney, Agent, or Firm*—Allison C. Collard; Thomas M. Galgano

[57] ABSTRACT

A board game apparatus which includes a plurality of player tokens, a random number generator, and a board having a multiplicity of playing spaces which cooperatively define at least one endless main path and a multiplicity of path branches leading off from the main path. The branches end in a circular subpath having a plurality of subspaces which surround an area subject to exclusive player control and certain of the subspaces permit access of a player's token to the area to permit exclusive appropriation thereof. The game is specifically intended to simulate a space exploration race.

7 Claims, 5 Drawing Figures

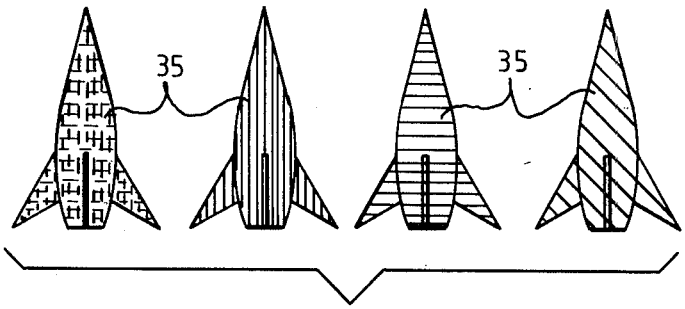
FIG.2
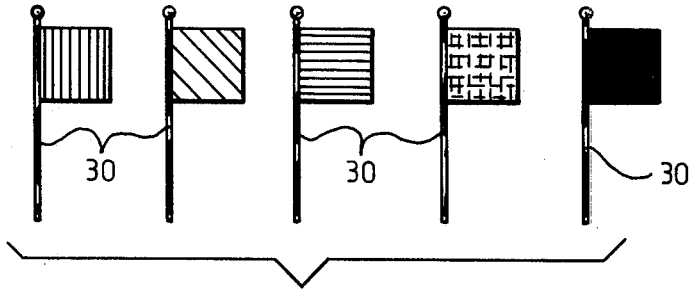
FIG.3
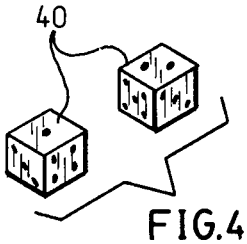
FIG.4
FIG.5
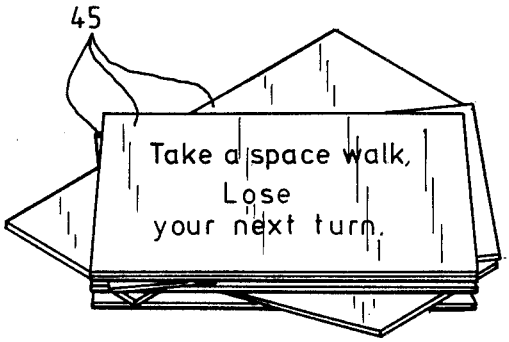

BOARD GAME APPARATUS

The present invention relates to a board game apparatus. More particularly, it relates to a board game apparatus which is intended to simulate a space exploration race.

Board and parlor games which are used to simulate various aspects of both real and imaginary experiences are, of course, well known and widely used both for entertainment as well as educational purposes. For example, there is the well known Monopoly board game (see U.S. Pat. No. 2,026,082), wherein the players attempt to build real estate monopolies and divest their opponents of their real estate holdings and cash assets. There has also been proposed an antitrust prosecuting board game (see U.S. Pat. No. 3,961,795) wherein the object is to break up monopolies rather than build them.

Other board games have been proposed which attempt to simulate other aspects of the fields of business, government, etc. However, so far as it is known, no board game apparatus is presently available which serves to promote one's awareness of the solar system and space exploration. Moreover, no board game apparatus of this type is known which is especially intended as an entertaining instructional aid for young children which promotes their awareness of the solar system and space exploration in a relatively simple and yet highly effective manner as herein proposed.

Accordingly, it is an object of the present invention to provide a novel board game apparatus which serves to promote one's awareness of the solar system and space exploration.

it is also an object of the present invention to provide such a novel board game apparatus which is both entertaining as well as educational.

It is a further object of the present invention to provide such a novel board game which is relatively easy and simple to play, especially designed for children and which may be economically fabricated.

Certain of the foregoing and related objects are readily attained in a board game apparatus which includes a plurality of player tokens, a random number generator, and a board having a playing field and a multiplicity of playing spaces formed on the playing field which cooperatively define at least one endless main path and a multiplicity of path branches leading off from the main path. The branches end in a circular subpath having a plurality of subspaces which surround an area subject to exclusive player control and certain of the subspaces permit access of a player's token to the area to permit exclusive appropriation thereof. The apparatus also includes means for indicating exclusive appropriation of the areas of exclusive player control.

Preferably, the multiplicity of path branches includes at least nine branches and the areas of exclusive player control each represent one of the planets of the solar system except Earth; one of the path branches ending in a circular subpath having a plurality of subspaces which surround an area representing the planet Earth which represents a starting and finishing space. Most desirably, the multiplicity of playing spaces includes a first set of spaces interspersed along the main path of spaces, each of which is associated with one of the planets and which has printed instructions thereon directing one to orbit the plurality of subspaces which surround the associated planet.

Most advantageously, the branches terminate in a pre-orbit space disposed adjacent to the circular subpath and the multiplicity of playing spaces includes a second set of spaces interspersed along the main path which is associated with the pre-orbit spaces and which permits a player to move the player's token from one of the spaces of the second set to one of the pre-orbit spaces. It is also advantageous, if the multiplicity of spaces includes a third set of spaces interspersed along the main path of spaces having directional arrows formed thereon for indicating particular path directions a player's token may take when landing on one of the spaces of the third set.

In a preferred embodiment of the invention, the multiplicity of spaces includes a fourth set of spaces interspersed along the main path and the apparatus additionally includes a deck of cards associated with the fourth set of spaces which has printed instructions thereon for the player whose token has landed on one of the spaces of the fourth set. It is also preferred that the random number generator comprises a pair of dice and that the players tokens comprise differently colored miniature rocket ships. It is further desirable that the areas of exclusive player control each have a peg-hole formed therein and that the means for indicating areas of exclusive player control comprises a multiplicity of differently-colored flags insertable in the peg-holes.

Other objects and features of the present invention will become apparent from the following detailed description considered in connection with the accompanying drawings which disclose one embodiment of the invention. It is to be understood, however, that the drawing is designed for the purpose of illustration only and not as a definition of the limits of the invention.

In the drawings, wherein similar reference characters denote similar elements throughout the several views:

FIG. 2 is a side view of four tokens used as playing pieces to represent each of the players;

FIG. 3 is a side view of five flags used in association with the game board;

FIG. 4 is a perspective view of a pair of dice used in association with the game board; and FIG. 5. is a perspective view of a stack of space cards used in association with the game board.

Figure 1:
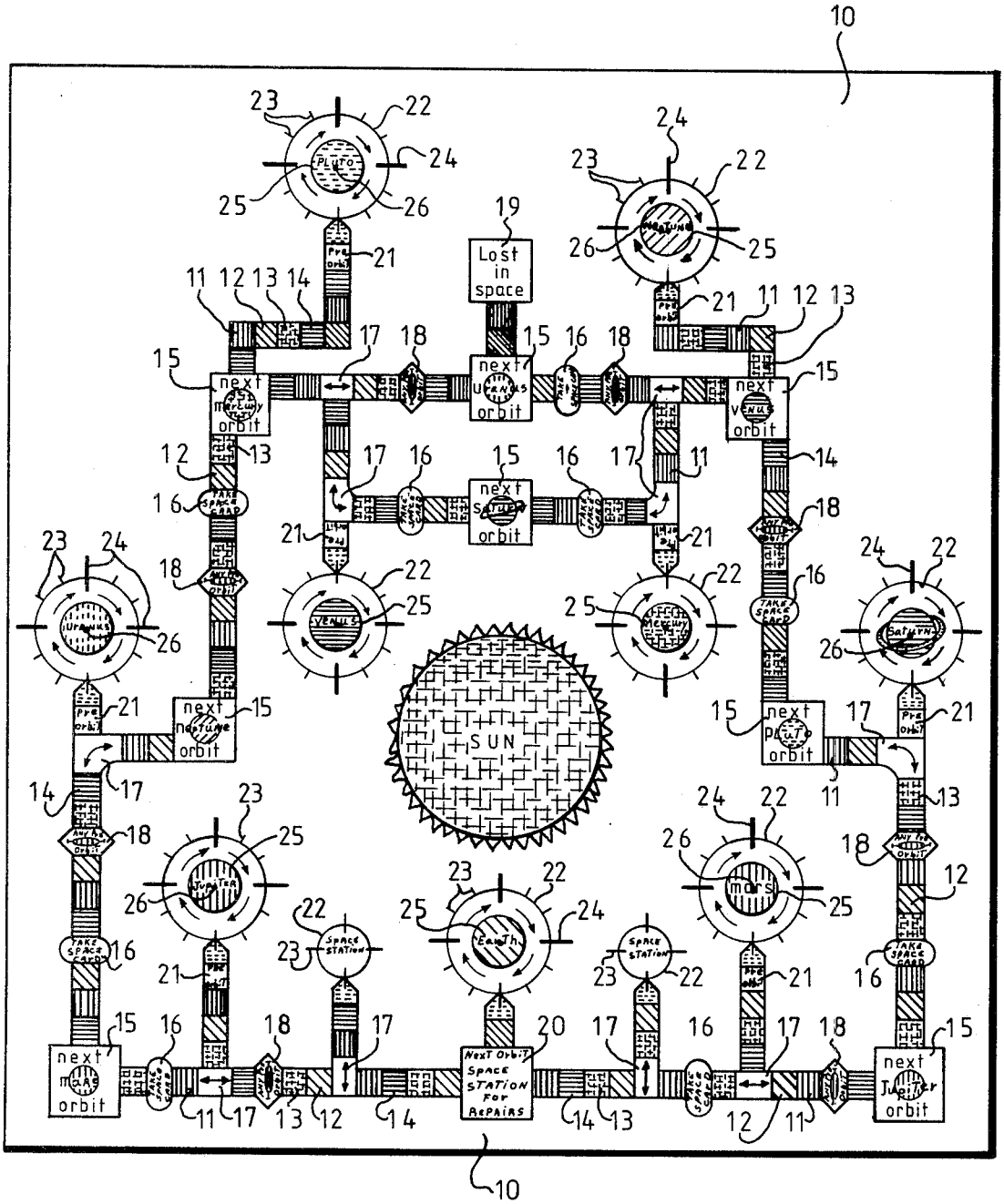
FIG. 1 is a top plan view of the game board used in association with the novel board game apparatus embodying the present invention.

Referring now in detail to the drawings and, in particular, FIG. 1 thereof, therein illustrated is a novel board game apparatus embodying the present invention which includes a flat game board 10 which may preferably have either a square or circular shape. Game board 10 has delineated thereon a branched, continuous path defined by a multiplicity of playing spaces.

Board 10 includes a multiplicity of differently colored, unlabeled playing spaces 11 (red), 12 (green), 13 (yellow), and 14 (blue), eight Next Orbit boxes 15 and nine, oval-shaped, take a Space Card spaces 16, the latter two of which are interspersed between the unlabeled playing spaces 11, 12, 13 and 14 (the purpose of the various playing spaces will be described in greater detail hereinafter.) In addition, there are also ten arrow directional spaces 17 and eight hexagonally-shaped Any Pre-orbit spaces 18 which are also interspersed among playing spaces 11, 12, 13 and 14. The playing spaces also include a Lost in Space box 19 and a Next Orbit-Space Station For Repairs box 20.

Branching or veering—off from the main endless path of playing spaces are a number of side branches which typically include a number of playing spaces 11, 12, 13 or 14 arranged in a row and a Pre-orbit box 21. At the end of each row is an orbit circle 22 which has a plurality of marked stops 23 disposed in a clock-face manner thereabout. In particular, there are two space stations orbit circles and nine planet orbit circles for each of the planets of the solar system. The planet orbit circles each have three heavily-darkened or colored marked stops 24 at the nine, twelve and three o'clock positions which define landing windows for landing on the particular planet designated. Each of the planet orbit circles or rings 22 surround a colored circular representation of a particular labeled planet 25 which has a peg-hole 26 formed in the center thereof for the receipt of a flag 30 (the purpose for which will also be described in more detail hereinbelow).

Each of the players is represented by a differently-colored preferably plastic playing piece, marker or token 35 (FIG. 2) for registering movement along the board, each of which is shaped like a rocket ship. Each player is also provided with six flags 35 (FIG. 3) having the same color as their rocket ship token 35.

Any suitable random-number generating means may be included with the game for indicating the length or extent of a player's move along the path as each player takes his turn at play. Preferably, a pair of dice 40 (FIG. 4) is employed.

In addition, there are also provided a total of fifteen different Space cards 45 which are placed in a stack on board 10. One of the Space cards 45 is picked from the stack by a player when his token 35 lands on one of the "Take A Space Card" spaces 16. Space cards 45 each contain instructions for the player to follow who picks the card. The instructions which each of the space cards contain are listed below in Table I.

TABLE I

| CARD NO. | CONTENTS OF SPACE CARDS INSTRUCTIONS |
|---|---|
| 1 | All systems A-Ok. Going better then expected. Throw dice and go again. |
| 2 | Main retro-rockets not firing properly. Cannot move until corrected. To correct, you must throw even number on dice. Go in your normal turn. Hold this card until corrected. |
| 3 | The planet Mars has been invaded and captured by alien beings from another galaxy. Remove flag if any, and place alien flag on Mars. This planet can be challenged the same as any other. |
| 4 | The planet Venus has been invaded and captured by alien beings from another galaxy. Remove flag if any, and place alien flag on Venus. This planet can be challenged the same as any other. |
| 5 | You are lost in space. Go directly to Lost in Space box. You must stay in box until set on correct course. To correct course, you must throw 6 or 8. Go in your normal turn. |
| 6 | Take a space walk. Lose your next turn. |
| 7 | The planet Mercury has been invaded and captured by alien beings from another galaxy. Remove flag if any, and place alien flag on Mercury. This planet can be challenged the same as any other. |
| 8 | This card is good for one extra orbit on any planet in order to capture or challenge. Hold this card until used. |
| 9 | The planet Saturn has been invaded and captured by alien beings from another galaxy. Remove flag if any, and place alien flag on Saturn. This planet can be challenged the same as any other. |
| 10 | Landing gear not working. You cannot capture any planets or take any space cards until corrected. To correct, you must throw 7 or doubles. Does not affect travel. Hold this card until corrected. |
| 11 | The planet Uranus has been invaded and captured by alien beings from another galaxy. Remove flag if any, and place alien flag on Uranus. This planet can be challenged the same as any other. |
| 12 | The planet Neptune has been invaded and captured by alien beings from another galaxy. Remove flag if any, and place alien flag on Neptune. This planet can be challenged the same as any other. |
| 13 | You are headed on a collision course with a meteorite. Throw dice and go again in any direction. |
| 14 | The planet Pluto has been invaded and captured by alien beings from another galaxy. Remove flag if any, and place alien flag on Pluto. This planet can be challenged the same as any other. |
| 15 | The planet Jupiter has been invaded and captured by alien beings from another galaxy. Remove flag if any, and place alien flag on Jupiter. This planet can be challenged the same as any other. |

Turning now to the playing of the game, the general object of the game is to capture more planets than your opponents and to return safely to Earth (by landing on one of Earth's landing windows 24) while still in possession of the conquered planets. The game is especially designed for two, three or four players. When played with two players, the object is to capture at least four planets and to return to Earth while still holding at least four planets. When played with three players, a player must capture three or more planets and land safely on Earth while still possessing three planets. When played with four players, teams of two can be formed and the game is played the same as with two players, except that although each player would have his own rocket, only one "team" rocket need land safely on Earth to win the game.

To start the game, all rockets 35 are placed on planet Earth and the first player throws the dice 40 and moves his rocket the number of spaces indicated by the dice, starting from the twelve o'clock window 24. Each player then follows in turn, each heading for a desired planet. When a player's rocket reaches another planet, he may orbit that planet twice, if the planet is unoccupied or not captured. If during the orbit around the orbit circle he lands on one of the landing windows 24, he has then captured the planet and may place one of his flags 30 into the center peg-hole 26 of the planet to signify its capture.

The captured planet may be challenged by opposing players. When challenging a planet, one may only orbit the captured planet once. If the challenger's rocket 35 lands on one of the landing windows, then his challenge is successful and he can remove his opponent's flag and replace it with his own.

It should be pointed out that anytime during the game, one die or two dice may be used at the player's discretion. In addition, once a planet is orbited, the planet cannot be orbited by the same player until he orbits at least one other planet. The only exception is that Earth may be orbited as many times as is necessary to land on one of its landing windows 24 in order to win the game.

As previously noted, there are a stack of space cards 45 associated with spaces 16 which contains instructions for a player to follow. Card number 3 states that the planet Mars has been captured by alien beings and that an alien flag is to be placed on Mars; additional black colored flags (FIG. 3) are provided to facilitate this purpose.

As also previously noted, there are eight Next Orbit boxes 15 which contain specific instructions from "Earth Command". In particular, these spaces order the rockets landing on them to proceed to orbit a particular planet; e.g., regardless of where the rocket was on its way to, if it lands on the box labeled "Next Orbit Mercury", it must orbit Mercury before anything else. Rockets with orders from Earth command may reverse course and disregard all other marked boxes until their mission is completed.

If a player lands on one of the "Any Pre-orbit boxes" 18, the player may place his rocket on the pre-orbit box 21 of any planet of his choice in order to capture or challenge a planet with the exception of Earth. If a player lands on one of the arrow directional spaces 17, the arrow directions must be followed, e.g. turn or go straight, but he cannot reverse course.

In accordance with the rules, with the exception of Earth, only one rocket can be in orbit about a planet at a time. Opposing rockets must wait one the associated pre-orbit box 21 until the rocket in orbit completes its turn. If the player chooses not to wait, he may change his direction from the pre-orbit path and continue onto another planet.

It should be pointed out that various modifications and changes may be made as will be apparent to those skilled in the art. For example, the game could possibly be played without the Space cards. In addition, the arrangement of the particular pathways could also be changed.

Thus, while only one embodiment of the present invention has been shown and described, it will be obvious to those persons of ordinary skill in the art, that many changes and modifications may be made thereunto, without departing from the spirit and scope of the invention.

What is claimed is:

1. A space exploration board game apparatus, comprising:

a plurality of player tokens;

a random number generator;

a board having a playing field and a multiplicity of playing spaces formed on said playing field which cooperatively define one continuous orbital main path and at least nine path branches leading off from said orbital main path, with eight of said branches ending in a circular subpath having a plurality of subspaces which surround an area subject to exclusive player control, each of which represents one of the planets of the solar system except Earth, with certain of said subspaces permitting access of a player's token to said area to permit exclusive appropriation thereof, and with the remaining one of said path branches ending in a circular subpath having a plurality of subspaces which surround an area representing the planet Earth, with certain of said subspaces permitting access of a player's token to said area representing Earth, and wherein said planet Earth represents a starting and finishing space, said multiplicity of playing spaces also including a first set of spaces interspersed along said main path of spaces, each of which is associated with one of said planets and which has printed instructions thereon directing one to orbit the plurality of subspaces which surround the associated planet, wherein each of said branches terminates in a pre-orbit space disposed adjacent to said circular subpath, and wherein said multiplicity of playing spaces includes a second set of spaces interspersed along said main path which is associated with said pre-orbit spaces and which permits a player to move the player's token from one of said spaces of said second set to one of said pre-orbit spaces.

2. The board game apparatus according to claim 1, wherein said multiplicity of spaces includes a third set of spaces interspersed along said main path of spaces having directional arrows formed therein for indicating particular path directions a player's token may take when landing on one of said spaces of said third set.

3. The board game apparatus according to claim 2, wherein said multiplicity of spaces includes a fourth set of spaces interspersed along said main path and wherein said apparatus additionally includes a deck of cards associated with said fourth set of spaces which has printed instructions therein for the player whose token has landed on one of said spaces of said fourth set.

4. The board game apparatus according to claim 1, wherein said random number generator comprises a pair of dice.

5. The board game apparatus according to claim 1, wherein said players tokens comprise differently-colored miniature rocket ships.

6. The board game apparatus according to claim 1, wherein said areas of exclusive player control each have a peg-hole formed therein and wherein said means for indicating comprise a multiplicity of differently-colored flags insertable in said peg-holes.

7. The board game apparatus according to claim 1, wherein said subspaces of each of said circular subpaths are arranged in a clock-face manner about the associated planet and wherein certain of said subspaces permitting access to the associated planet are located at the nine, twelve and three o'clock positions and wherein said pre-orbit spaces are located adjacent to the six o'clock position.

* * * * *